US006815629B2

(12) United States Patent
Seto et al.

(10) Patent No.: US 6,815,629 B2
(45) Date of Patent: Nov. 9, 2004

(54) HYDRAULIC PRESSURE ACTUATING APPARATUS FOR CIRCUIT BREAKER

(75) Inventors: Shinji Seto, Tokyo (JP); Yasuhide Takeda, Tokyo (JP); Daisuke Ebisawa, Tokyo (JP); Masayuki Uchiyama, Tokyo (JP); Atsuji Watanabe, Tokyo (JP); Hideo Kawamoto, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/438,882

(22) Filed: May 16, 2003

(65) Prior Publication Data

US 2003/0213774 A1 Nov. 20, 2003

(30) Foreign Application Priority Data

May 17, 2002 (JP) ..... 2002-142295
Mar. 28, 2003 (JP) ..... 2003-089570

(51) Int. Cl.[7] ..... H01H 35/38
(52) U.S. Cl. ..... 218/92; 218/84; 200/82 B
(58) Field of Search ..... 218/84, 120, 154, 218/7, 91–116, 14, 43, 51, 56, 66, 78, 86, 88, 153, 140; 200/82 B; 91/517, 518, 451, 452

(56) References Cited

U.S. PATENT DOCUMENTS 3,832,502 A * 8/1974 Grieger ..... 218/66
5,353,594 A * 10/1994 Yamashita et al. ..... 91/361
5,476,030 A * 12/1995 Plettner ..... 91/38
5,604,340 A 2/1997 Yamada et al.
5,750,950 A 5/1998 Nogami et al.
5,804,787 A 9/1998 Daimon et al.

FOREIGN PATENT DOCUMENTS

JP 7-217401 8/1995

* cited by examiner

*Primary Examiner*—Lincoln Donovan
*Assistant Examiner*—M. Fishman
(74) *Attorney, Agent, or Firm*—Crowell & Moring LLP

(57) ABSTRACT

In a hydraulic pressure actuating apparatus for a circuit breaker, contacts of the circuit breaker have a moving contact and a stationary contact for turning on/off current. A shaft, at an end portion of which is attached the moving contact, and at the other end of which is attached a piston, is received within a cylinder. A directional control valve exchanges oil pressure for actuating the piston. For changing over the directional control valve, pilot valves are provided. Each pilot valve has a pair of valve bodies, each opposing to each other, and springs. One of the valve bodies is able to stroke up to contact with the valve body of the other valve body, therefore giving no ill influences upon actuating time, even if drawback occurs in the pilot valves in the hydraulic pressure actuating apparatus for the circuit breaker.

13 Claims, 16 Drawing Sheets

HYDRAULIC PRESSURE ACTUATING APPARATUS FOR CIRCUIT BREAKER

BACKGROUND OF THE INVENTION

The present invention relates to a hydraulic pressure actuating apparatus for a circuit breaker, and in particular, to a hydraulic pressure actuating apparatus being suitable for use in a circuit breaker for use in electric power supply.

With the conventional circuit breaker, as was described in Japanese Patent Laying-open No. Hei 7-217401 (1995), for example, a hydraulic device for a high-tension circuit breaker has an actuating piston for use in a traveling or moving contact point thereof. The traveling contact point has two (2) pieces of pistons connected to a high-pressure tank under the closing condition, and those two (2) pistons are driven by high-pressure liquid acting thereon. In circuit breaking, a directional control valve operates so that a flow passage is formed at a low-pressure side of the piston. Pilot valves for closing and pilot valves for cutting-off actuate the directional control valve. And, the two (2) pieces of the pilot valves for use in circuit cutting-off are connected to the directional control valve.

In the circuit breaker described in the Japanese Patent Laying-Open No. Hei 7-217401 (1995) mentioned above, when one of the pilot valves will not operated since something abnormal occurs therein, then only the other pilot valve actuates, thereby causing a drawback that the time is changed, being necessary for making contacts open and close in the circuit breaker. With the circuit breaker for use in electric power supply, the time necessary for the circuit breaker to open the contacts thereof (i.e., a time period from an open-circuit instruction up to the time when the contact point is opened), as well as, the time to close the contacts (i.e., a time period from a close-circuit instruction up to the time when the contact point is contact with) must be within a predetermined range of time. Also, if the circuit breakers are provided for each of the phases, it is necessary that the difference in operation time is small between those phases. Further, it is also desired to make the circuit breaker small-sized by reducing the numbers of bodies, in which the valves are inserted, and/or conduits formed, as well as, to reduce the cost thereof.

BRIEF SUMMARY OF THE INVENTION

An object of the present invention, for dissolving the drawback of the conventional arts mentioned above, is to provide a hydraulic pressure actuating apparatus for a circuit breaker, with which reliability of the circuit breaker can be improved. Other object, according to the present invention, is to provide a hydraulic pressure actuating apparatus for a circuit breaker, with which the actuating time of the circuit breaker can be kept constant for a long time. And further other object, according to the present invention, is to provide hydraulic pressure actuating apparatus for a circuit breaker, which can be made small in sizes thereof, thereby reducing the cost thereof.

For accomplishing the object mentioned above, according to the present invention, there is provided a hydraulic pressure actuating apparatus for a circuit breaker, for opening/closing a contact point having a moving contact and a stationary contact by actuating a piston received within a cylinder, comprising: a directional control valve for exchanging pressure for actuating said piston; and a circuit-close pilot valve and an circuit-open pilot valve for making a flow passage open/close, being connected to said directional control valve, wherein in each of said pilot valves, two (2) pieces of valve bodies are positioned opposing to each other, and movable directions of said valve bodies are directed substantially opposite to each other.

Further, according to the present invention, in the hydraulic pressure actuating apparatus for a circuit breaker, as described in the above, wherein preferably, said valve bodies are disposed, so that they are in contact with each other, when one of said valve bodies is changed in position up to maximum stroke while the other valve body is changed in position at minimum stroke, or the maximum strokes of said valve bodies are made almost equal to each other. And, further, it is preferable that flow passage area of the pilot valve changes in proportion with a stroke of said valve body, or a spring is connected between said valve bodies.

DETAILED DESCRIPTION OF THE INVENTION

Figure 1:
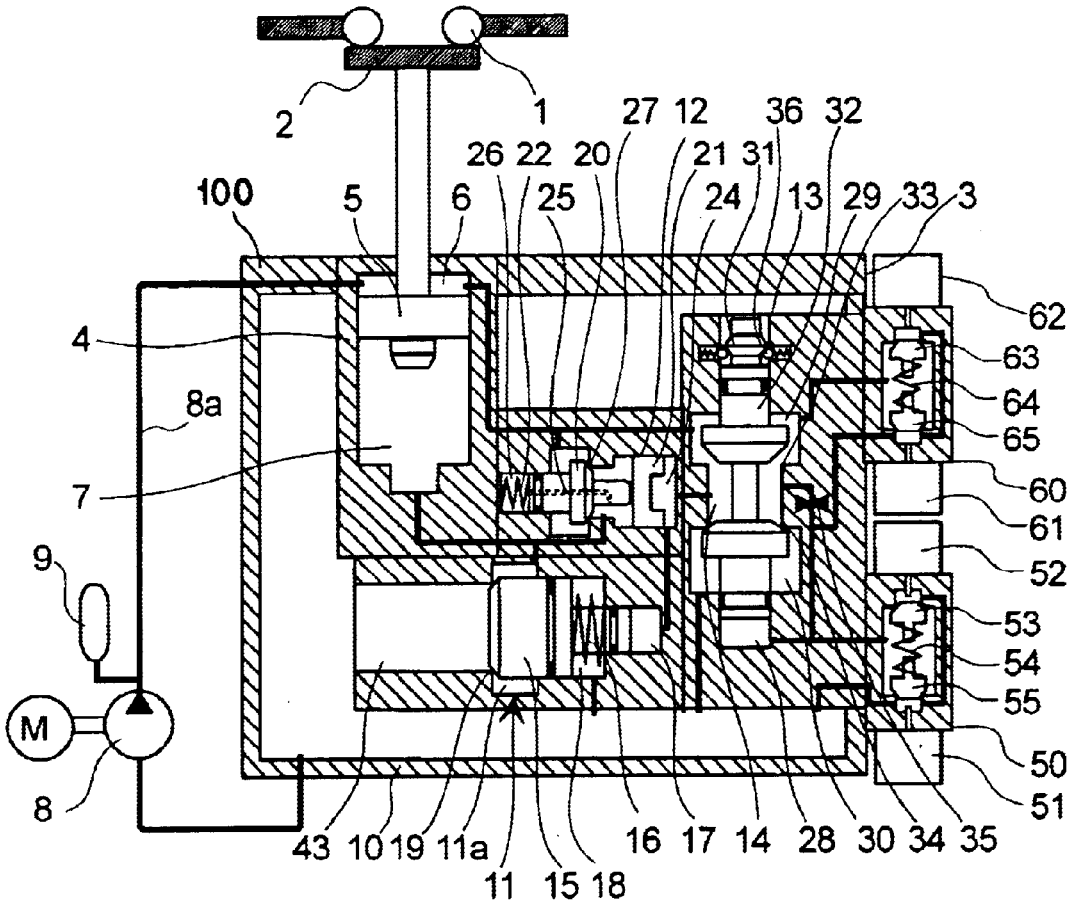
FIG. 1 is a vertical cross-section view of an embodiment of a circuit breaker, according to the present invention, in particular, in a circuit-closing condition thereof.
Figure 2:
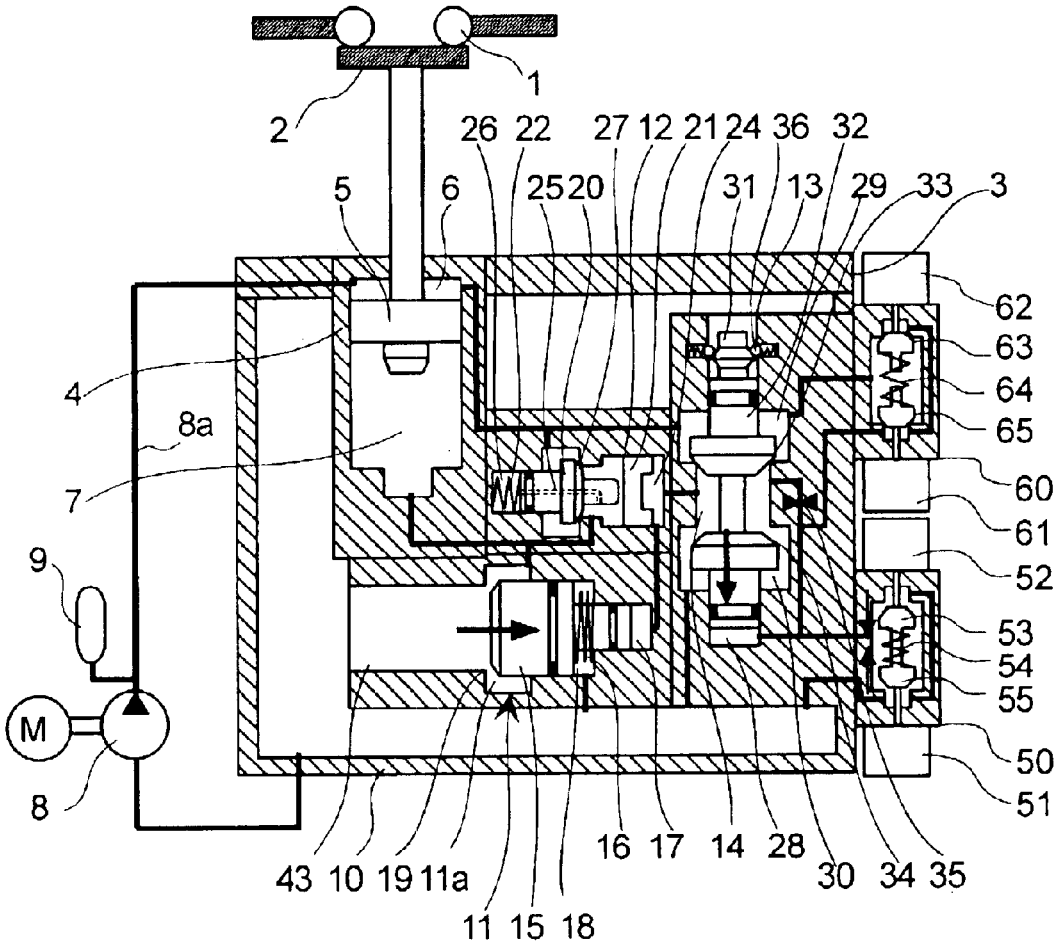
FIG. 2 is a vertical cross-section view of the circuit breaker shown in FIG. 1, in particular, for showing an initial condition during a normal circuit-opening operation thereof.
Figure 3:
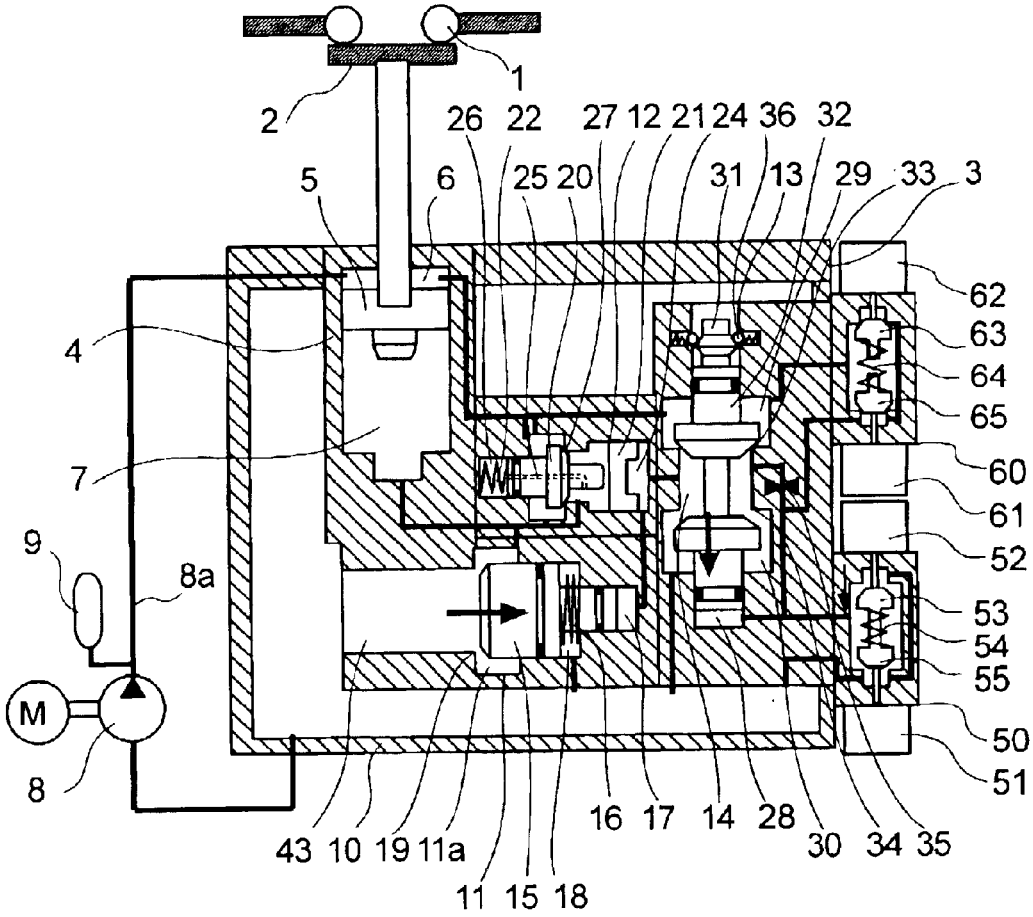
FIG. 3 is a vertical cross-section view of the circuit breaker shown in FIG. 1, for showing an initial condition during the circuit-opening operation thereof, in particular, when one of circuit-open pilot valves will not operate.
Figure 4:
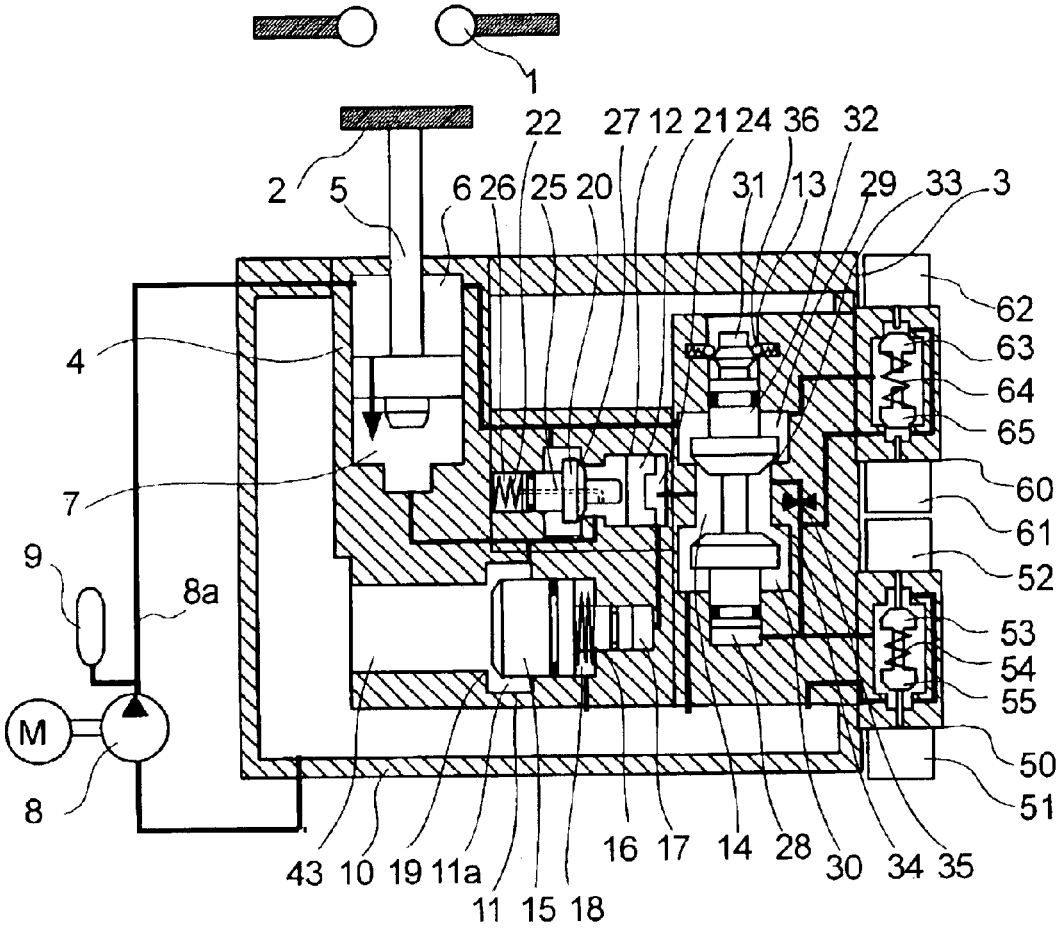
FIG. 4 is a vertical cross-section view of the circuit breaker shown in FIG. 1, in particular, for showing a condition of the latter period during the circuit-opening operation thereof.

Hereinafter, an embodiment of a hydraulic pressure actuating apparatus for a circuit breaker, in accordance with the present invention, will be fully explained by referring to one of the FIGS. 1 to 8 attached herewith. FIG. 1 shows a vertical cross-section view of the hydraulic pressure actuating apparatus for the circuit breaker. The circuit breaker is in the condition of closing circuit thereof (i.e., turning electricity on condition). FIGS. 2 and thereafter are also the cross-section views, being same to FIG. 1, but they are different from in the operating condition thereof. Thus, FIG. 2 shows an initial condition in a normal circuit-opening operation, and FIG. 3 shows the initial condition in the circuit-opening operation, but when one of circuit-open pilot valves will not operate. Also, FIG. 4 shows a condition of the latter period during the circuit-opening operation, FIG. 5 the circuit-closing condition (i.e., turning electricity off), FIG. 6 an initial condition during the circuit-closing operation, FIG. 7 an initial condition during the circuit-closing operation, but when one of the circuit-close pilot valves will not operate, and FIG. 8 a condition the latter period during the circuit-closing operation thereof.

In FIG. 1, the circuit breaker 100 for making a contact point open/close has a stationary contact 1 and a moving contact 2. The hydraulic pressure actuator 3 for actuating the circuit breaker 100 comprises a piston 5, and a fluid pressure cylinder 4 received within the piston 5. The fluid pressure cylinder 4 is divided into a small pressure-receiving area 6 and a large pressure-receiving area 7 by the piston 5. Upon a side of the small pressure-receiving area 6 is always acting supply pressure of the actuating fluid, which is discharged from a hydraulic pressure source 8 and is reserved with pressure within an accumulator 9. On a side of the large pressure-receiving area defining a cylinder-operating chamber 7, either the supply pressure at high pressure or the pressure of returning fluid of a reservoir 10 is applied selectively, by exchanging between open/close of a circuit-open main valve 11 and a circuit-close main valve 12. The reservoir 10 collects and reserves the fluid discharged from this hydraulic pressure actuating apparatus.

The circuit-open main valve 11 is made up with a two-way valve, and it brings the cylinder-operating chamber 7 to conduct with the reservoir 10 of low pressure, thereby bringing the piston 5 to operate to close the circuit. To a circuit-open main valve pilot chamber 17 being formed at one side end of the circuit-open main valve, a control port 14 for the directional control valve 13 is connected. A spring 16 for closing the valve body 15 of the circuit-open main valve 11 is provided on a reverse surface side of the valve body 15. The force of the spring 16 and also the fluid pressure of the circuit-open main valve pilot chamber 17 at high pressure are utilized for closing the valve body 15. Also, to the circuit-open main valve pilot chamber 17 is applied the fluid, which is pushed out from the cylinder-operating chamber 7, and the valve body 15 is opened when the pressure within the circuit-open main valve pilot chamber 17 comes down to low pressure due to this pressure of fluid. On a rear surface of the valve body 15 is formed a low-pressure chamber 18, and this low-pressure chamber 18 is always conducting to a return side. An inner diameter of the circuit-open main valve pilot chamber 17, due to provision of this low-pressure chamber 18, is made smaller than that of a valve seat 19, which is formed at an end portion of the valve body 15. Herein, setting is made on the circuit-open main valve 11, with a pressure receiving area and a fluid pressure thereon, so that the force acting from the right-hand side to be loaded onto the circuit-opening main valve pilot chamber 17 is made larger than the force acting from the left-hand side of the valve seat 19, under the condition of closing the valve.

The circuit-close main valve 12 is made up with a two-way valve, and it brings the cylinder-operating chamber 7 to conduct with the supply-side conduit 8*a* of high pressure, thereby closing the circuit by using the piston 5. The circuit close main valve 12 has a valve body 20 and a piston 21 contacting with a shaft of the valve body 20. On the reverse side surface of the valve body 20 is positioned a spring 22. The force of this spring 22 acts upon the valve body 20. To a main valve pilot chamber 24 which is formed between the cylinder of the circuit-close main valve 12 and the piston 21, the control port 14 of the directional control valve 13 is connected, in a similar manner to the circuit open main valve pilot chamber 17. On a reverse side surface of the valve body 20 of the circuit-close main valve 12 is formed an auxiliary chamber 26, and to this auxiliary chamber 26 is conducted the cylinder-operating chamber 7 through a guide opening 25 passing from an axial center of the valve body 20 to a side surface thereof.

A diameter of the valve seat 27 of the valve body 20 is smaller than an inner diameter of the circuit-close main valve pilot chamber 24, i.e., the outer diameter of the piston 21, and further it is larger than an inner diameter of the auxiliary chamber 26. When bringing the circuit-close main valve pilot chamber 24 to be low in pressure, upon the valve body 20 act the forces of spring 22, the pressure of supply fluid acting depending on the area difference, i.e., due to the discrepancy in the radius between the valve seat 27 and the auxiliary chamber 26, and the pressure of fluid acting upon the auxiliary chamber 26, thereby closing the valve body 20. When bringing the circuit close main valve pilot chamber 24 to be high pressure, the valve body 20 is opened due to the high pressure of this fluid.

The directional control valve 13 is made from a three-way valve having two positions, which has a valve body 31, being formed with two (2) valve portions at a middle portion thereof on an axial direction. At one axial end portion of the directional control valve 13 is formed a directional control valve pilot chamber 28. For the purpose of driving the valve body 21, two (2) pilot valves 50 and 60 are connected to the directional control valve 13. The directional control valve pilot chamber 28 rises up the pressure therein, when opening the circuit-close pilot valve 60 while closing the circuit-open pilot valve 50. Also, it comes down to low pressure when closing the circuit-close pilot valve 60 while opening the circuit-open pilot valve 50. By exchanging between the low pressure and the high pressure, the control port 14 being conducting to the main circuit-open valve pilot chamber 17 and the circuit-close main valve pilot chamber 24, is connected to either on of the supply side valve chamber 29 conducting to the supply side of high pressure, or the return side valve chamber 30 of low pressure conducting to the return side of low pressure.

A rear surface side axial portion 32 of the valve portion of the valve body 31 is made smaller in the diameter than a supply side valve seat 33. The pressure receiving area of the directional controller valve pilot chamber 28 is larger than a difference between the cross-section area of the return side valve seat 34 and the cross-section area of the rear side axial portion 32 of the valve body. Accordingly, when bringing the directional controller valve pilot chamber 28 to be low in pressure, the valve body 31 moves downward due to the supply pressure acting upon an area of difference between the supply side valve seat 33 and the rear side axial portion 32 of the valve portion. On the other hand, when bringing the directional controller valve pilot chamber 28 into the high pressure, an upward force generated due to the high supply pressure prevails over the downward force acting upon the area of difference mentioned above, thereby moving the valve body 31 upward. However, the directional controller valve pilot chamber 28 is conducted to the valve chamber having the control portion 14.

On further rear surface side of the rear side axial portion 32 of the valve body is provided a holding mechanism 36. The holding mechanism 36 holds the valve body 31, mechanically, when no fluid pressure acts thereupon. In the normal operation where the fluid pressure acts, holding force generated by means of the holding mechanism 36 is in such degree that it can be neglected.

The circuit-close pilot valve 60 has solenoids 61 and 62 for use of closing circuit, being positioned to oppose to each other. When exciting the circuit-close solenoid valve 61, the valve body 65 is opened, while the valve body 63 is opened when exciting the circuit-close solenoid 62. When releasing those solenoids 61 and 62 from the excitation thereof, then the valve bodies 63 and 65 are closed due to the spring force from a spring 64 provided between the valve bodies 63 and 65. In the similar manner, the circuit-open pilot valve 50 has solenoids 51 and 52, being position to oppose to each other. The valve body 55 is opened when exciting the circuit-open solenoid 51, while the valve body 53 is opened when exciting the circuit-open solenoid 52. When releasing those solenoids 51 and 52 from the excitation thereof, then the valve bodies 53 and 55 are closed due to the spring force from a spring 54, which is provided between the valve bodies 53 and 55.

In the circuit-close pilot valve 60, the valve bodies 63 and 65 are positioned, opposing to each other, and moving direction of both the valve bodies 63 and 65 lies in vertical (up and down) in FIG. 1. For this reason, the valve bodies 63 and 65 move to hit on each other when the solenoids 61 and 62 are excited, therefore the valve bodies 63 and 65 are restricted on the movement thereof by each other. On the same reason, in the circuit-open pilot valve 50, the two (2) valve bodies 53 and 55 are restricted on the movement thereof by each other.

A primary side of the circuit-close pilot valve 60 is connected to the supply side of high pressure, while a secondary side is connected to the primary side of the circuit-open pilot valve 50 and the directional controller valve pilot chamber 28. A secondary side of the circuit-open pilot valve 50 is also connected to the return side of low pressure. Both the circuit-close pilot valve 60 and the circuit-open pilot valve 50 are made of a poppet valve, so that an area of flow passage is nearly proportional to an amount of movement of the valve body.

Explanation will be given hereinafter, on the operation of the present embodiment, being constructed in such the manner as was mentioned above.

Under-the condition of closing circuit, which is shown in FIG. 1, the cylinder-operating chamber 7, the circuit-open main valve pilot chamber 17, the circuit-close main valve pilot chamber 24, the directional controller valve pilot chamber 28, and the primary side of the circuit-close pilot valve 60 and the primary side of the circuit-open pilot valve 50 are all at high pressure. And, all of those valves are closed.

Under this condition, when a circuit-open instruction is generated from an upper controller apparatus not shown in the figure, the circuit-open solenoids 51 and 52 are excited, and then the valve bodies 55 and 53 of the circuit-open pilot valve 50 are pushed to open. Since the directional controller valve pilot chamber 28 is conducted to the return side of low pressure, therefore the directional controller valve 13 is changed into the condition of circuit-opening operation due to the high-pressure acting upon the valve chamber, which has the supply side valve chamber 29 and the control port 14. At this time, the valve bodies 53 and 55 are in contact with each other, at a half portion of the full-stroke thereof, and then they will not open any more.

If drawback occurs, such as, that the circuit-open solenoid 51 will not operate, that the valve body 55 adheres to so that it will not operate, or that the force generated by the circuit-open solenoid 52 is larger than that generated by the circuit-open solenoid 51, etc, for example, then the valve body 53 makes the full-stroke, as is shown in FIG. 3. When the valve body 53 makes the full-stroke, the valve body 55 is pushed by the valve body 53 to be closed. The area of flow passage when opening the poppet valve comes to be proportional to an amount of a lift, i.e., an amount of movement of the poppet valve in the axial direction thereof.

When one of the valve bodies 53 and 55 makes the full-stroke, the area of flow passage of the actuating fluid flowing from the primary side to the secondary side comes to be nearly equal to the sum of the areas of flow passages at two (2) positions where the actuating fluid flows from the primary side to the secondary side, when the valve bodies 53 and 55 stop, respectively, at a half of the full-stroke thereof. A velocity of exchanging the directional controller valve 13 comes to be fast as the flow passage increases in the area where the actuating fluid flows from the primary side to the secondary side of the open-circuit pilot valve. Since the areas of the flow passages are equal to, in FIGS. 2 and 3, therefore the actuating velocity of the exchange valve 13 will not change.

Since the directional controller valve 13 has been changed into the condition of circuit opening operation, the control port 14 and the circuit-open main valve pilot chamber 17 connected thereto is conducted to the return side, thereby being low in pressure. The circuit-open main valve 11 is opened due to the high-pressure fluid within the cylinder-operating chamber 7 owned by the fluid pressure cylinder 4, thereby bringing the cylinder-operating chamber 7 to be conducted to the return side. With this, the piston 5 and the moving contact 2 start the circuit opening operation.

Since the high pressure is loaded on the small pressure-receiving area 6 of the cylinder 4, the fluid within the cylinder-operating chamber 7 is pushed out therefrom. In this instance, the pressure within the valve chamber 11*a* rises up, and then the circuit-open main valve 11 keeps the opening condition thereof. FIG. 4 shows the condition in the latter period during the circuit opening operation where the circuit-open main valve 11 remains to open. When the piston 5 completes the circuit opening operation thereof, the fluid is stopped from flowing from the cylinder-operating chamber 7 to the return side. In the circuit-open main valve 11, there is no difference between the pressures at the right-hand side and the left-hand side, in FIG. 4. Then, the circuit-open main valve 11 is closed by the function of the spring 16. On the other hand, since the excitation is released from the circuit-open solenoid valves 51 and 52, and also the circuit-open pilot valve 50 is closed by the spring force. Thus, all the valves are closed, again. This condition is shown in FIG. 5.

After operation of the directional controller valve 13, the operations are completely same to each other, even in the case of FIG. 2 or in FIG. 3. Accordingly, in the cases shown in FIGS. 2 and 3, opening time of contacts will not change. However, since the circuit-open main valve pilot chamber 17 comes down to be low pressure, and then accompanying with that, also the pressure within the circuit-close main valve pilot chamber 24 comes down to be low. For this reason, the piston 21 of the circuit-close main valve 12 moves to the right-hand side, once. However, since having been closed from the beginning, the circuit-close main valve 12 remains to be closed even when only the piston 21 moves. As a result of that, the circuit-open operation by means of the directional controller valve 13 mentioned above will not influenced by the circuit-close main valve 12.

Figure 5:
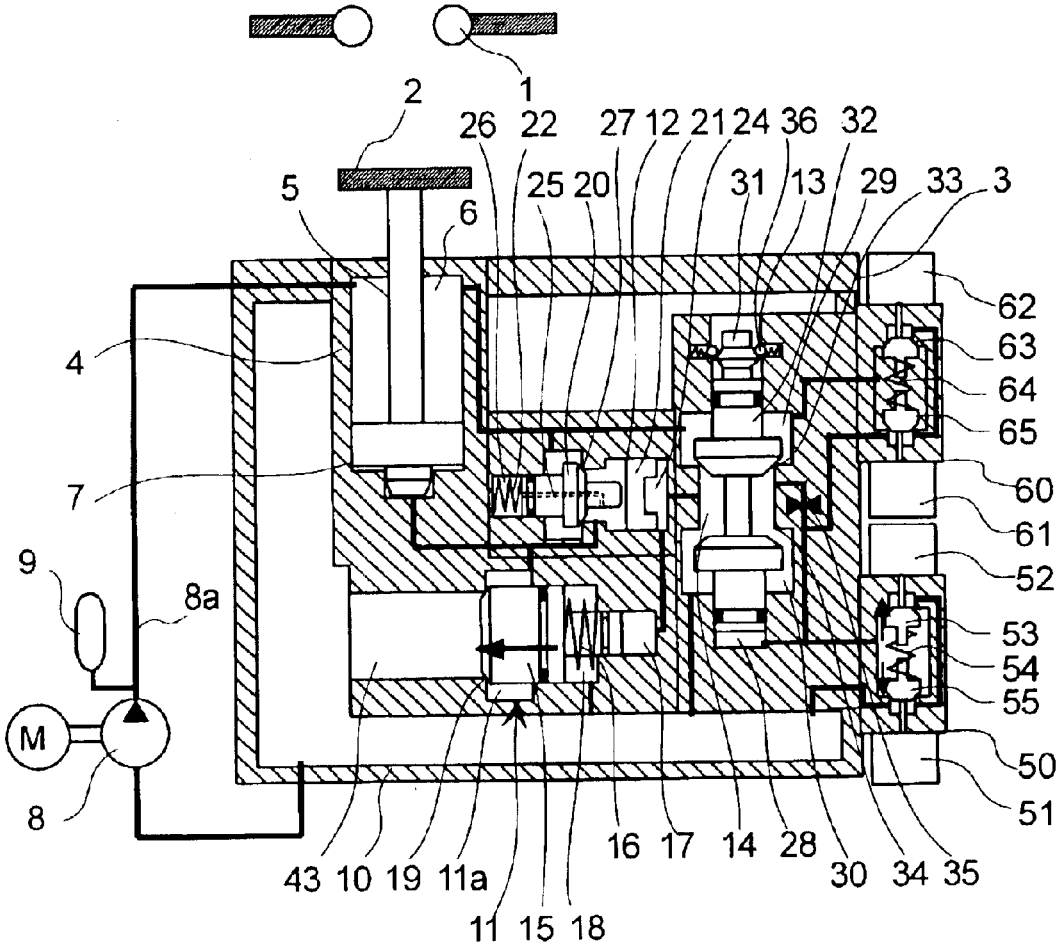
FIG. 5 is a vertical cross-section view of the circuit breaker shown in FIG. 4, in particular, for showing the circuit-closing condition thereof.
Figure 6:
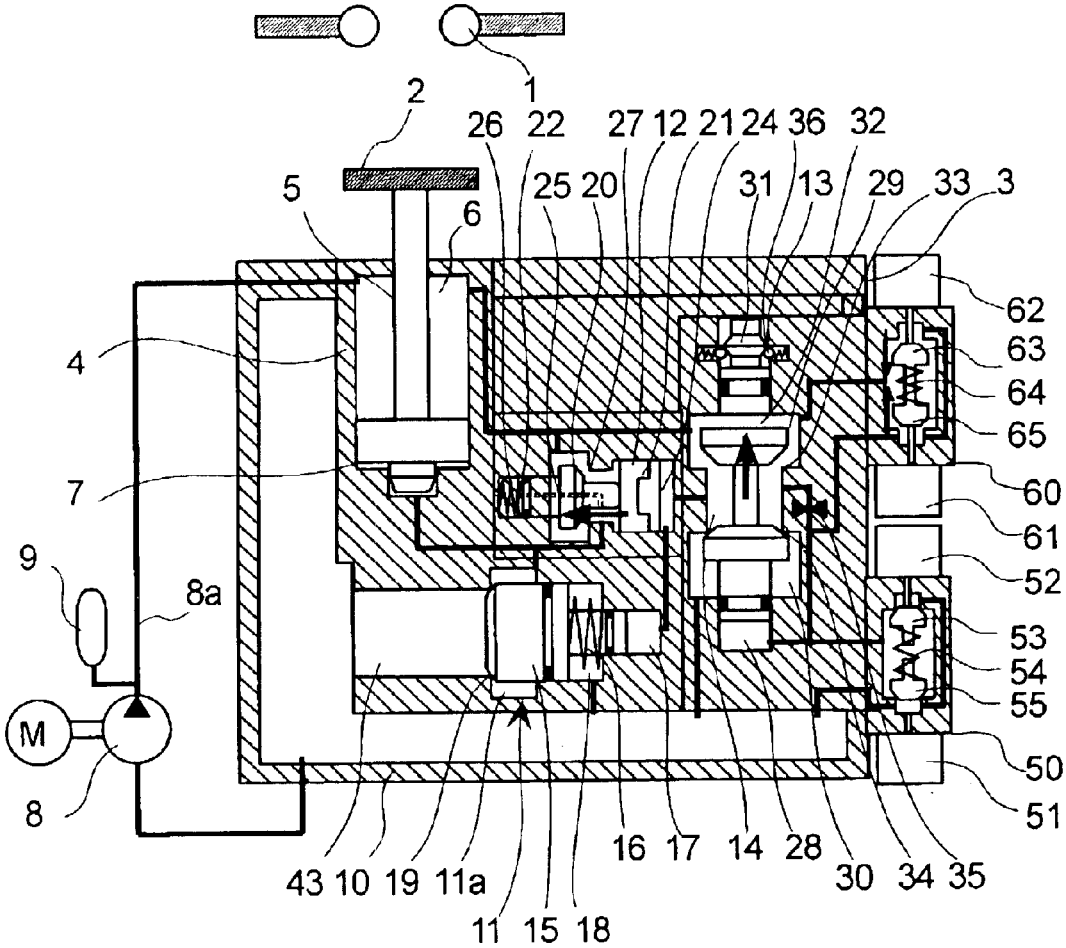
FIG. 6 is a vertical cross-section view of the circuit breaker shown in FIG. 4, in particular, for showing an initial condition during the normal circuit-closing operation thereof.

FIG. 6 shows the situation where a circuit-close instruction is generated from the upper controller apparatus not shown in the figure, under the circuit opening condition shown in FIG. 5. The circuit-close solenoids 61 and 62 are excited. The circuit-close pilot valve 60 is pushed to open by the function of the circuit-close solenoids 61 and 62, and then the actuating fluid flows from the primary side of the pilot valve 60 conducted to the supply side into the secondary side thereof. The directional controller valve pilot chamber 28 comes up to be high in pressure, and the directional controller valve 13 is changed over into the condition of circuit closing operation. In this instance, the valve bodies 63 and 65 are in contact with at the half portion of the full-stroke, respectively, and prevent the pilot valve 60 from opening much more than that.

Figure 7:
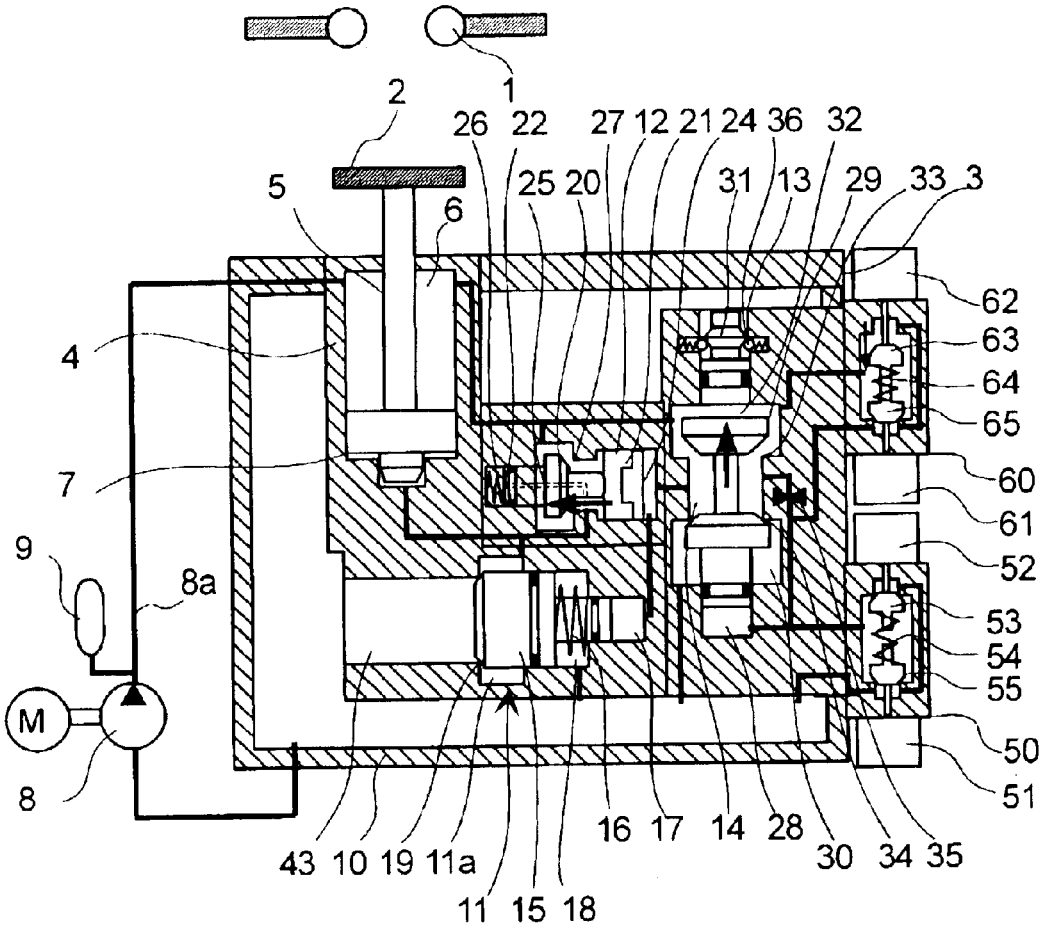
FIG. 7 is a vertical cross-section view of the circuit breaker shown in FIG. 4, in particular, for showing an initial condition during the circuit-closing operation thereof when one of circuit-close pilot valves will not operate.
Figure 8:
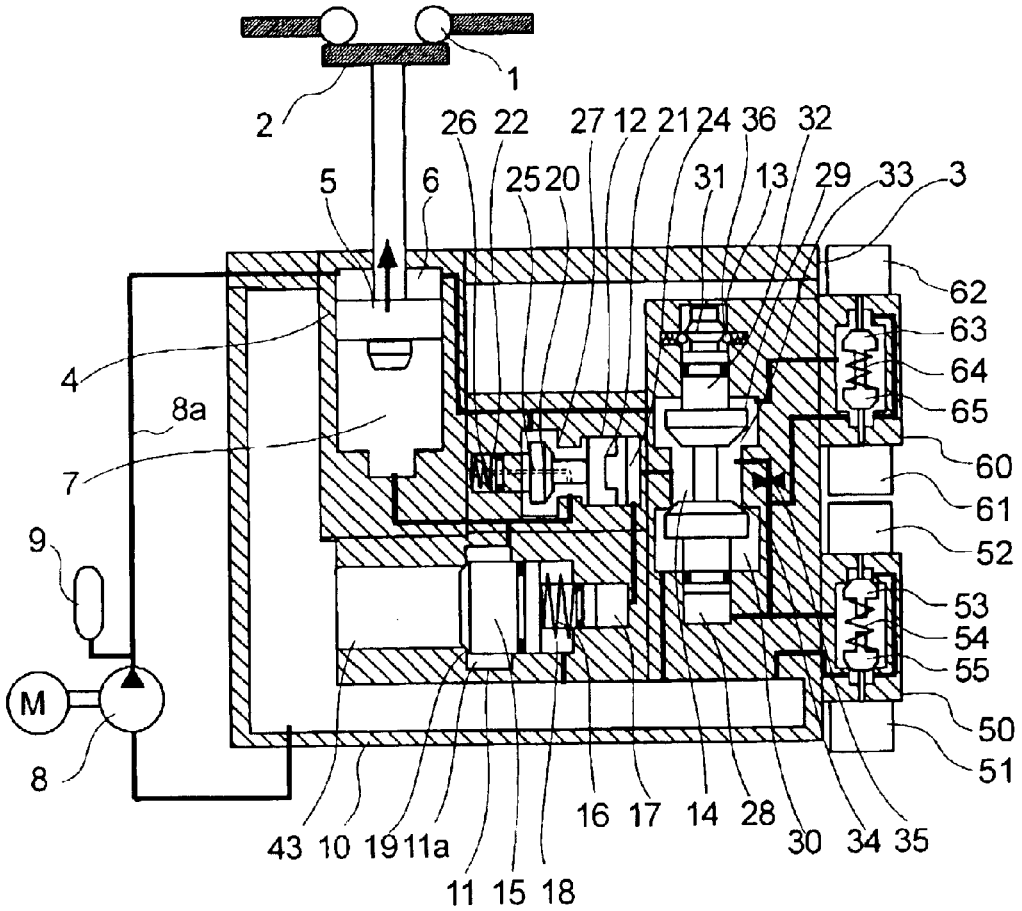
FIG. 8 is a vertical cross-section view of the circuit breaker shown in FIG. 7, in particular, for showing a condition of the latter period during the circuit-closing operation thereof.

If drawback occurs, such as, that the circuit-close solenoid 61 will not operate, that the valve body 65 adheres to so that it will not operate, or that the force generated by the circuit-close solenoid 62 is larger than that generated by the circuit-close solenoid 61, etc, for example, then the valve body 53 makes the full-stroke operation, as shown in FIG. 7. When the valve body 63 makes the full-stroke, the valve body 65 is pushed by the valve body 63 to close. In this circuit-close instruction, in the similar manner to that when the circuit-open instruction is generated, the area of flow passage (see FIG. 7) to the flow passage of the actuating fluid flowing from the primary side into the secondary side, in particular, when one of the valve bodies 63 and 65 makes the full-stroke, is nearly equal to the sum of the areas (see FIG. 6) of flow passages at the two (2) places where the actuating fluid flows from the primary side into the secondary side. Therefore, the actuating velocity of the directional controller valve 13 will not change between the cases shown in FIGS. 6 and 7.

When the directional controller valve 13 operates as shown in FIGS. 6 and 7, the circuit-close main valve pilot chamber 24 is conducted to the control port 14. With this, the control port 14 and the circuit-close main valve pilot chamber 24 rises up in the pressure thereof, and the piston 21 of the circuit-close main valve 12 and the valve body 20 move to the left-hand side in the figure, thereby opening the circuit-close main valve 12. The cylinder-operating chamber 7 is conducted to the high-pressure side, and then the piston 5 formed in one body with the moving contact 2 starts the circuit closing operation. In this instance, the cylinder-operating chamber 7 is turned to be the high pressure, instantaneously when the cylinder operation is started.

Accompanying with an increase of the pressure within the cylinder-operating chamber 7, also the pressure within the auxiliary chamber 26 rises up. However, the pressure will not come up to the supply pressure during when the piston 5 moves. Namely, the power is generated within the cylinder-operating chamber 7, overwhelming the pressure of supply fluid acting upon the small pressure-receiving area 6 of the cylinder, the mass of the moveable contact 2, etc., as well as, the friction force due to a packing provided around the piston 5, not shown in the figure, and so on, thereby being able to actuate the piston 5. This power can be determined, in general, by a ratio in the areas between the small pressure-receiving area 6 and the pressure-receiving area in the cylinder-operating chamber 7. Since the pressure-receiving area is larger, then the pressure within the cylinder-operating chamber 7 comes to be lower than the supply pressure.

Under the condition where the pressure lower than the supply pressure acts upon the cylinder-operating chamber 7, the piston 21 is pushed toward the left-hand side due to the supply pressure applied into the close-circuit main valve chamber 12. When the piston 21 is pushed toward the left-hand side, also the valve body 20 neighboring to this piston 21 is pushed to the left-hand side. Herein, on the valve body 20 and the piston are generated forces from the left-hand side. Thus, it is a force due to the pressure of actuating fluid acting upon a gap portion of difference in the diameter between the piston 21 and the valve seat 27, and a force due to the supply pressure acting upon a gap portion of difference in the diameter between the valve sear 27 and the auxiliary chamber 20, etc. On the other hand, upon the valve body 20 and the piston 21 forces a regenerated from the right-hand side, due to the pressure of actuating liquid acting upon the circuit-close main valve pilot chamber 24.

When setting force of the spring 22 to be smaller than the force of fluid pressure, since the pressure acting upon the auxiliary chamber is lower than the supply pressure during when the piston 5 performs the circuit closing operation, then the force acting from the right-hand side is larger than the force acting from the left-hand side. With this, the valve body 20 maintains the condition of being pushed down to the left-hand side, and the piston 5 continues the circuit closing operation. When the directional controller valve 13 is changed into the condition of circuit closing operation, also the circuit-open main valve pilot chamber 17 comes up to high in pressure. However, since the circuit-open main valve 11 has been closed since before starting the operation thereof, it only results in an increase of force to close the valve, and therefore it gives no harmful effect onto the circuit closing operation.

When the piston 5 is stopped after completing the circuit closing operation, the flow of actuating fluid stands still. Also the pressures within the cylinder-operating chamber 7, the guide opening 25 and the auxiliary chamber 26 come up to the supply pressure. The valve body 20 of the circuit-close main valve 12 and the piston 12 are pushed toward the right-hand side due to the force of the spring 22, and the circuit-close main valve 12 and the piston 12 is closed. As a result of those series of operations, the circuit breaker reaches to the circuit closing condition shown in FIG. 1. Operations of the circuit-close main valve 12 and the piston 5 after the operation of the directional controller valve 13 are same to those in the cases shown in FIGS. 6 and 7; thus, the closing time of contacts will not change.

According to the present embodiment, even in a case where drawback occurs in only one of the solenoids and the pilot valves therein, the valves can actuate at the same velocity to that under the normal condition thereof, and thereby improving reliability of the hydraulic pressure actuator for the circuit breaker.

Other embodiment according to the present invention will be explained by referring to any one of FIGS. 9 to 16.

Figure 9:
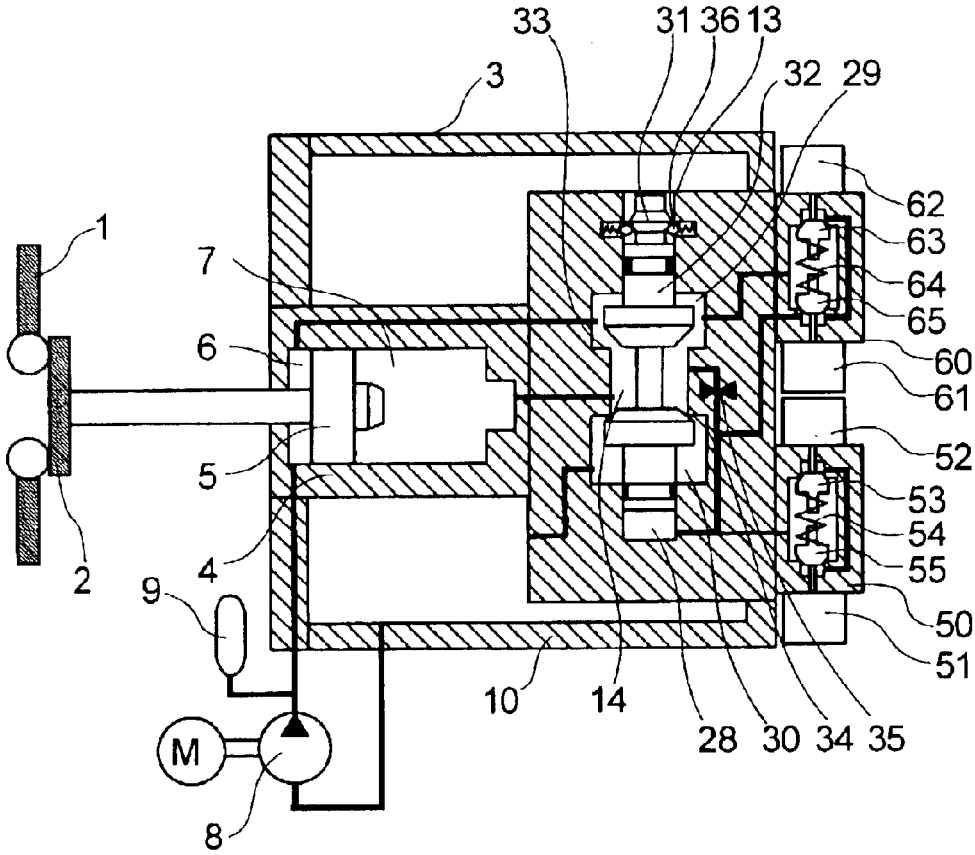
FIG. 9 is a vertical cross-section view of the circuit breaker, according to other embodiment of the present invention, in particular, for showing the circuit-closing condition thereof.
Figure 10:
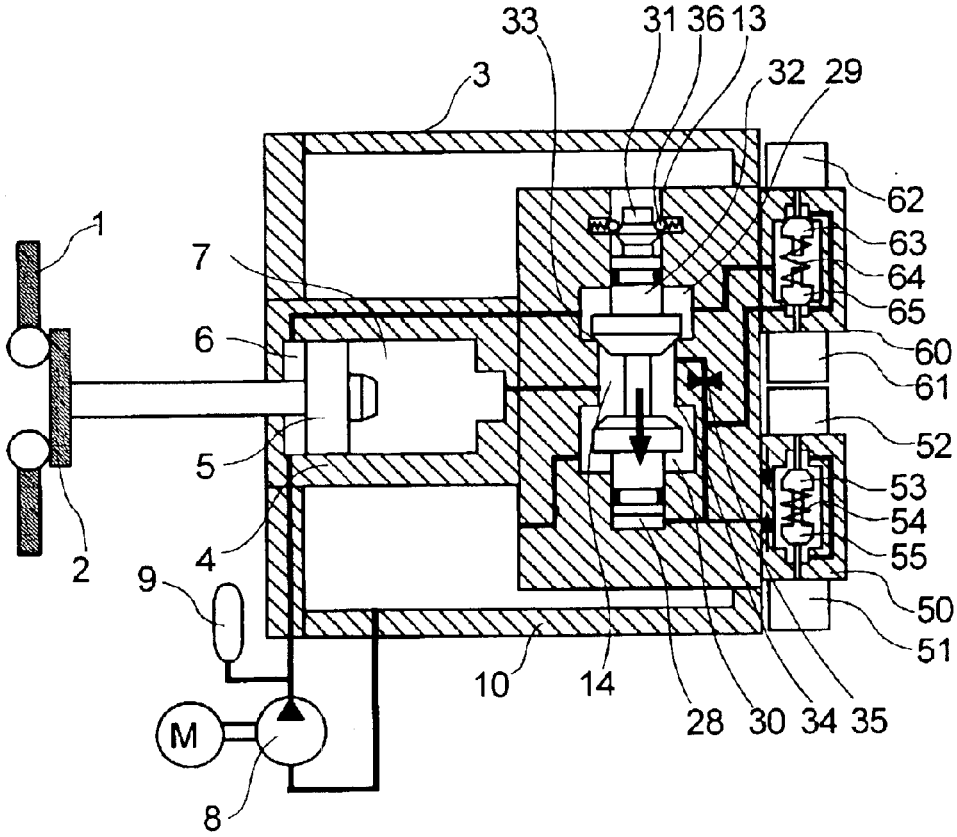
FIG. 10 is a vertical cross-section view of the circuit breaker shown in FIG. 9, in particular, for showing an initial condition during a normal circuit-opening operation thereof.
Figure 11:
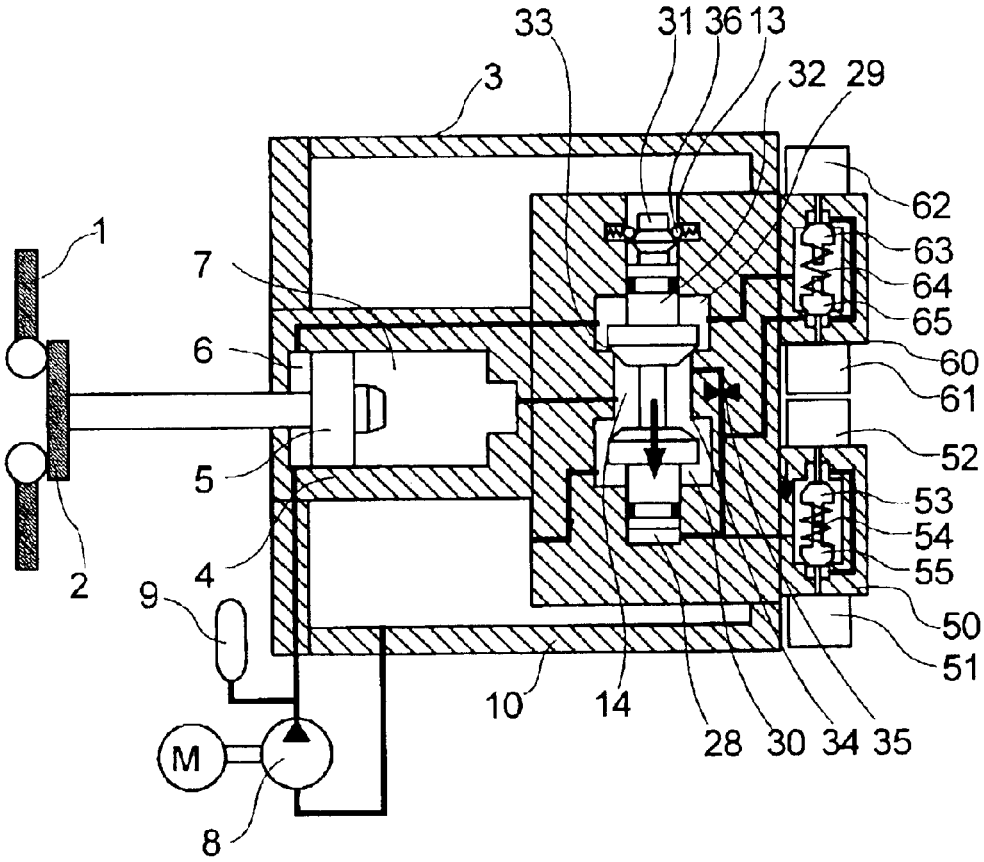
FIG. 11 is a vertical cross-section view of the circuit breaker shown in FIG. 9, in particular, for showing an initial condition during the circuit-opening operation thereof, when one of circuit-open pilot valves will not operate.
Figure 12:
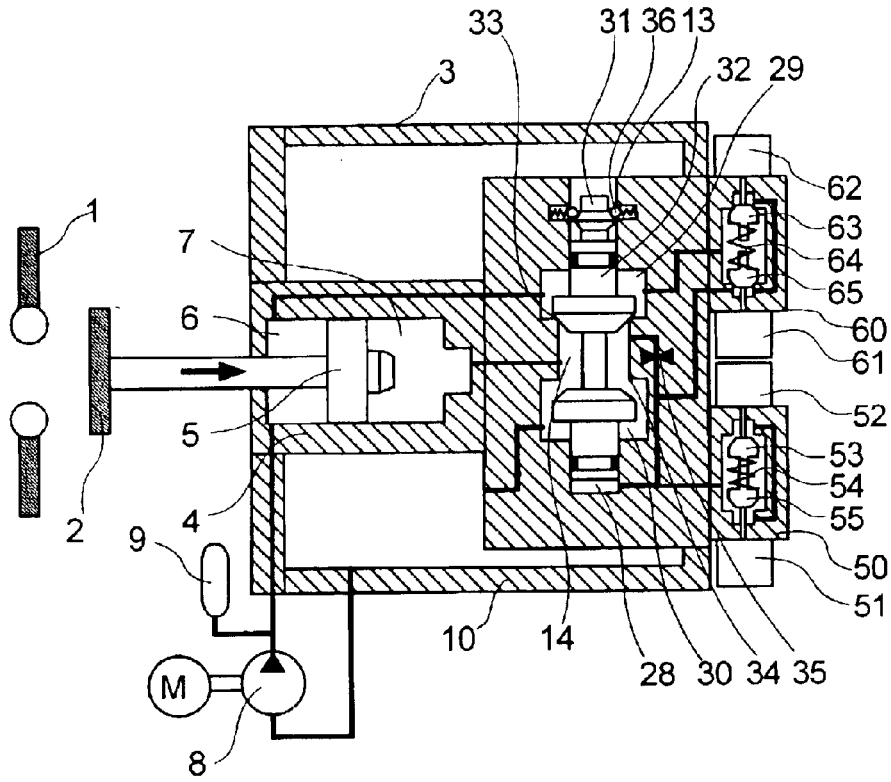
FIG. 12 is a vertical cross-section view of the circuit breaker shown in FIG. 9, in particular, for showing a condition of the latter period during the circuit-opening operation thereof.
Figure 13:
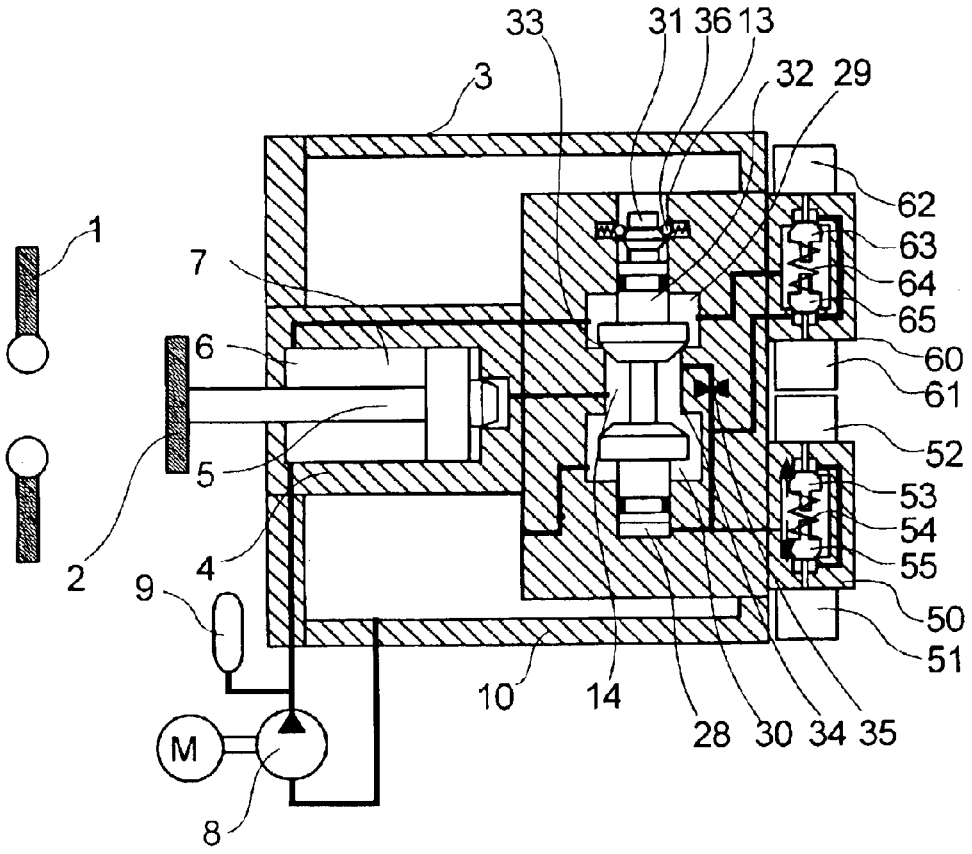
FIG. 13 is a vertical cross-section view of the circuit breaker shown in FIG. 9, in particular, for showing the circuit-opening condition thereof.
Figure 14:
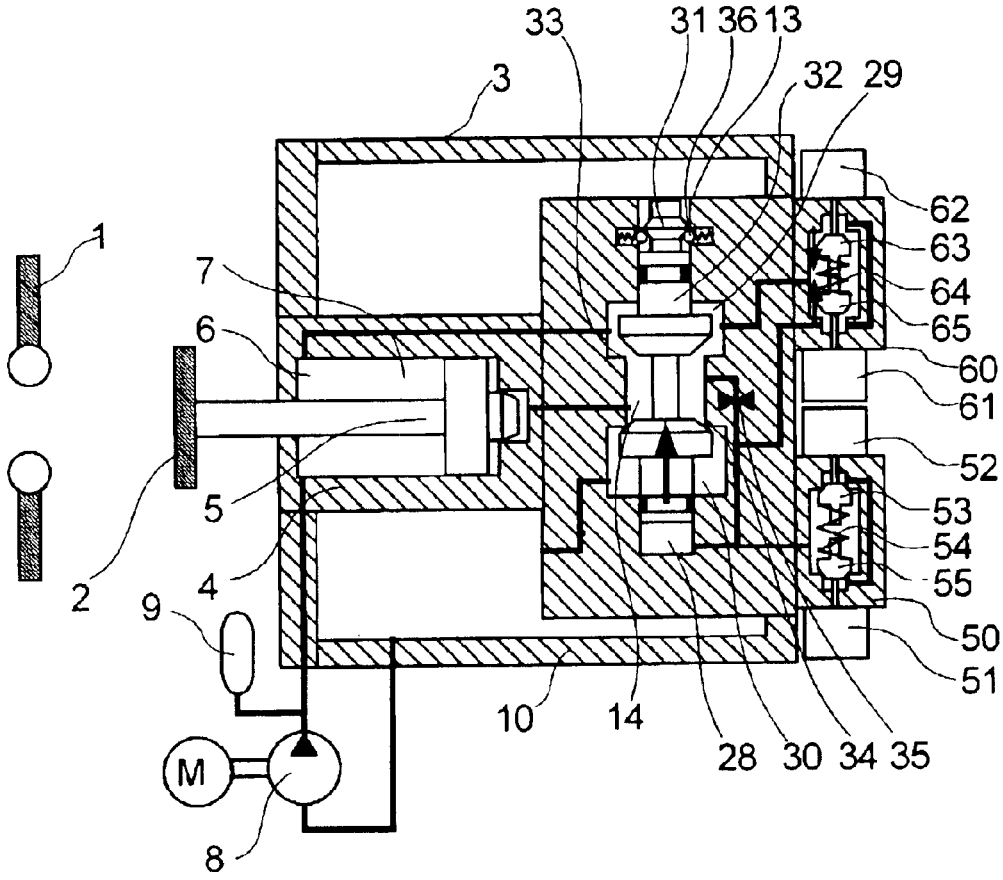
FIG. 14 is a vertical cross-section view of the circuit breaker shown in FIG. 9, in particular, for showing an initial condition during a normal circuit-closing operation thereof.
Figure 15:
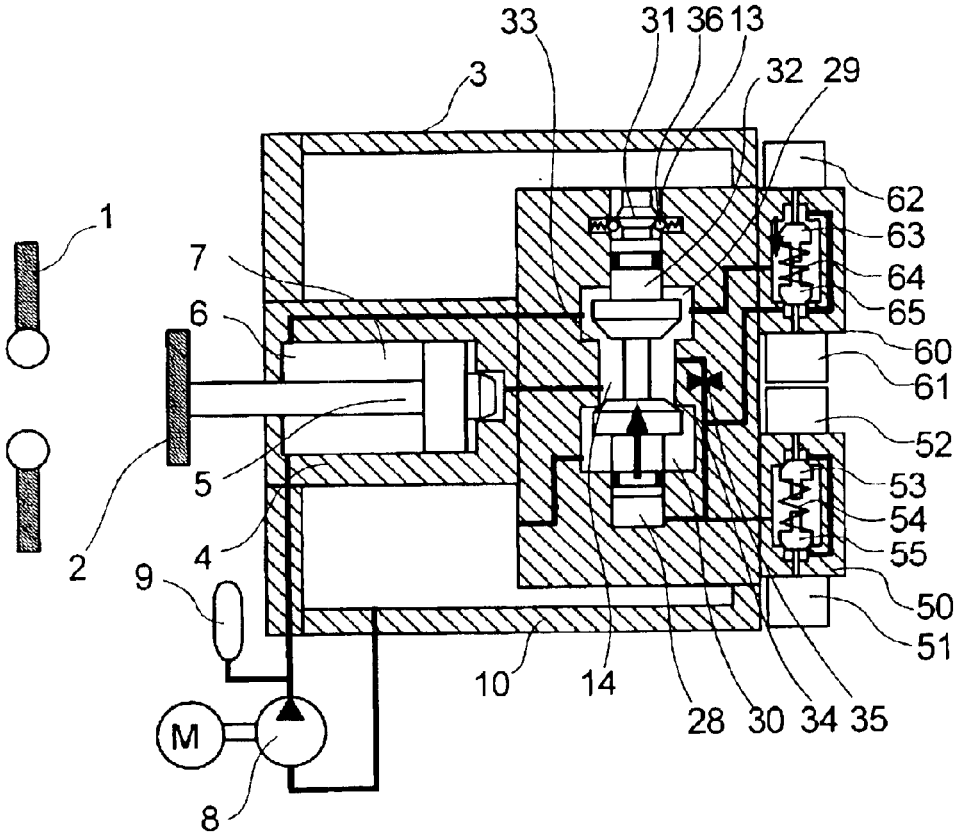
FIG. 15 is a vertical cross-section view of the circuit breaker shown in FIG. 9, in particular, for showing an initial condition during the circuit-closing operation thereof, when one of circuit-close pilot valves will not operate.
Figure 16:
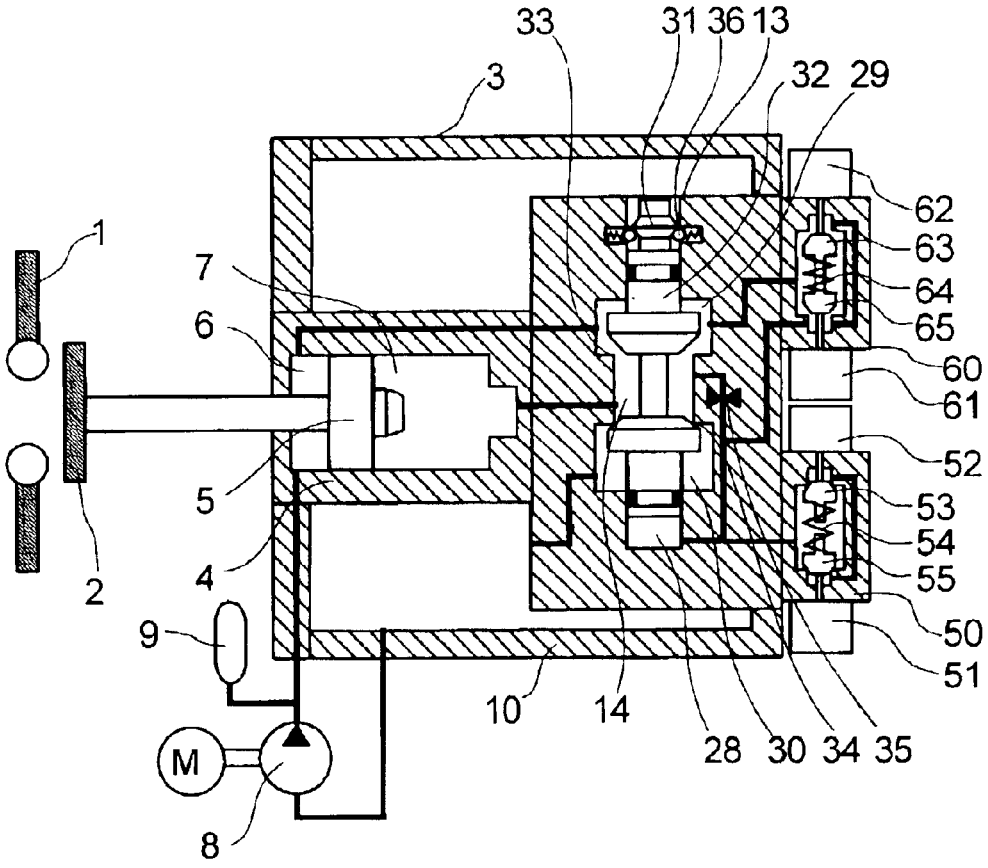
FIG. 16 is a vertical cross-section view of the circuit breaker shown in FIG. 9, in particular, for showing a condition of the latter period during the circuit-closing operation thereof.

In the present embodiment, the control port 14 of the directional controller valve 13 is connected to the cylinder operation chamber 7 of the fluid pressure cylinder, but omitting the circuit-open main valve 11 and the circuit-close main valve 12, which was adopted in the embodiment shown in any one of FIGS. 1 to 8. With this, the directional controller valve actuates the fluid pressure cylinder, directly. FIG. 9 shows the circuit closing condition when electricity is turned on, FIG. 10 an initial condition during the normal circuit opening operation, and FIG. 11 an initial condition in the case of circuit opening operation when one of the circuit-open pilot valves will not operate. Also, FIG. 12 shows a condition of the latter period during the circuit opening operation, FIG. 13 the circuit opening condition where the circuit breaker is cut off, FIG. 14 an initial condition during the normal circuit closing operation, FIG. 15 an initial condition in a case where one of the pilot valves will no operate, and FIG. 16 a condition of the latter period during the circuit closing operation. Except for an aspect that the circuit-open main valve 11 and the circuit-close main valve 12 are omitted, but all others are same in the structures to those shown in any of FIGS. 1 to 8. Accordingly, the conditions shown in any one of FIGS. 9 to 16 corresponds to the condition shown in any one of FIGS. 1 to 8.

The present embodiment is suitable for a case where actuating the circuit breaker from a small capacity to a middle capacity. Also, in the present embodiment, since the fluid pressure cylinder is actuated, directly, by means of the directional controller valve, therefore the difference in time necessary for actuating the directional controller valve effects on the opening time of contacts or the closing time of contacts, largely. However, applying the pilot valves therein brings the directional controller valve not to change the actuation time thereof, and therefore it will not give ill influences upon the operation of the circuit breaker.

Although the poppet valve is applied as to the pilot valve in every embodiment mentioned above, however a spool valve may be applied in the place of the poppet valve. Also, since the open-circuit pilot valve and the close-circuit pilot valve operate independently, therefore only one of the open-circuit pilot valve and the close-circuit pilot valve may be made in such the structure as was mentioned above. Furthermore, in the embodiment mentioned above, though two (2) pieces of valve bodies of the pilot valves are in contact with each other, however they may be made not to contact with.

As was fully explained in the above, according to the present invention, since two (2) pieces of valve bodies of the pilot valves are positioned opposing to each other in one valve chamber, it is possible to make the circuit breaker small in sizes, as well as, to reduce the cost thereof. Also, since the two (2) pieces of valve bodies are made in contact with each other, so as to restrict the operation of the valve bodies, the actuation time cannot be affected even if drawback occurs in one (1) pieces of the pilot valve, and thereby achieving the circuit breaker having high reliability.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraces therein.

What is claimed is:

1. A hydraulic actuating apparatus for a circuit breaker in which a moving contact and a stationary contact are opened and closed by actuating a piston received within a cylinder, comprising:

a directional controller for exchanging pressure for actuating said piston; and a circuit-close pilot valve and a circuit-open pilot valve for making a flow passage open/close, being connected to said directional controller valve, wherein each of said pilot valves comprises valve bodies having two pieces positioned opposite each other and disposed within one valve chamber, and movable directions of said valve bodies are directed substantially opposite to each other.

2. The hydraulic actuating apparatus for a circuit breaker, as described in the claim 1, wherein said valve bodies are disposed, so that they are in contact with each other, when one of said valve bodies is changed in position up to maximum stroke while the other valve body is changed in position at minimum stroke.

3. The hydraulic actuating apparatus for a circuit breaker, as described in the claim 1, wherein said valve bodies are disposed, so that they are in contact with each other, when one of said valve bodies is changed in position up to maximum stroke while the other valve body is changed in position at minimum stroke.

4. The hydraulic actuating apparatus for a circuit breaker, as described in the claim 2, wherein the maximum strokes of said valve bodies are made almost equal to each other.

5. The hydraulic actuating apparatus for a circuit breaker, as described in the claim 1, wherein at least one of said pilot valves is made from a poppet valve.

6. The hydraulic actuating apparatus for a circuit breaker, as described in the claim 3, wherein flow passage area of the pilot valve changes in proportion with a stroke of said valve body.

7. The hydraulic actuating apparatus for a circuit breaker, as described in the claim 1, wherein a spring is connected between said valve bodies.

8. The hydraulic actuating apparatus for a circuit breaker, as described in the claim 1, wherein a spring is connected between said valve bodies.

9. The hydraulic actuating apparatus for a circuit breaker, as described in the claim 2, wherein a spring is connected between said valve bodies.

10. The hydraulic actuating apparatus for a circuit breaker, as described in the claim 3, wherein a spring is connected between said valve bodies.

11. The hydraulic actuating apparatus for a circuit breaker, as described in the claim 4, wherein a spring is connected between said valve bodies.

12. The hydraulic actuating apparatus for a circuit breaker, as described in the claim 5, wherein a spring is connected between said valve bodies.

13. The hydraulic actuating apparatus for a circuit breaker, as described in the claim 6, wherein a spring is connected between said valve bodies.

* * * * *